US007377452B2

(12) United States Patent
Jones et al.

(10) Patent No.: US 7,377,452 B2
(45) Date of Patent: May 27, 2008

(54) CLEANING APPARATUS FOR PAINT SPRAY GUNS

(75) Inventors: Michael B. Jones, Excelsior, MN (US); Wayne Robens, Lakeville, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 386 days.

(21) Appl. No.: 10/757,225

(22) Filed: Jan. 14, 2004

(65) Prior Publication Data

US 2005/0150521 A1 Jul. 14, 2005

(51) Int. Cl.
*B05B 15/02* (2006.01)

(52) U.S. Cl. ..... 239/112; 239/106; 239/110; 239/289; 239/302

(58) Field of Classification Search ..... 239/106, 239/112, 289, 302, 310, 315–317, 338, 344, 239/354, 110; 134/166 C, 166 R, 169 C, 134/186, 200

See application file for complete search history.

(56) References Cited

U.S. PATENT DOCUMENTS 3,194,444 A * 7/1965 Hubert ..... 137/205.5
4,809,913 A * 3/1989 Gunlock ..... 239/317
5,485,857 A * 1/1996 Amundsen ..... 134/102.2
6,328,639 B1 * 12/2001 Pujol ..... 451/89
6,488,216 B1 * 12/2002 Lewis ..... 239/106

* cited by examiner

*Primary Examiner*—Kevin P. Shaver
*Assistant Examiner*—Jason J Boeckmann
(74) *Attorney, Agent, or Firm*—Faegre & Benson LLP

(57) ABSTRACT

Apparatus and method for cleaning a paint cup, spray tip, and wetted parts from a hand held paint spray gun wherein the gun is disassembled after use and internal wetted parts needing cleaning are inserted into the paint cup, a cleaning cap is attached to the paint cup, and a garden hose is used to flush paint from the interior of the paint cup and the parts contained therein. In another aspect, the cleaning cap is attached to and used to flush an extended suction set having an elongated double lumen hose and adapter. The cleaning cap has a fitting adapted to receive a conventional garden hose and further has a passageway to allow water to exit from the cap after flushing the interior of the paint cup.

19 Claims, 21 Drawing Sheets

CLEANING APPARATUS FOR PAINT SPRAY GUNS

FIELD OF THE INVENTION

The present invention relates to the field of hand held paint sprayers, more particularly, to spray guns having a local or remote refillable paint reservoir for use with an airless atomizing paint spray gun.

BACKGROUND OF THE INVENTION

In the past, refillable paint spray guns have proven to be a very popular consumer product category. Although such guns may be used to spray non-water based coatings, for example, oil-based paint and stain, such guns are typically most often used for applying latex or water-based paints and similar coatings. The proper use of such guns requires cleaning of the internal parts of such guns exposed to the material sprayed, i.e., the "wetted parts." Because such coating materials are generally designed to provide a tenacious permanent protective layer to the surface to which they are applied, and because certain internal parts of spray guns fit together with very close tolerance clearances, cleaning of the spray gun must be both prompt and thorough.

The present invention provides assistance in cleaning after applying water-based coatings by reducing the effort and time needed to perform such cleaning. It also provides more convenience to the user in such cleaning, and is thus expected to enhance the popularity of products offering such improved convenience.

DETAILED DESCRIPTION OF THE INVENTION

As used herein "paint" is to be understood to be any material suitable for spraying with the equipment described herein, provided such material is also suitable for clean-up using water. Such material includes, but is not necessarily limited to, latex paint.

Figure 1:
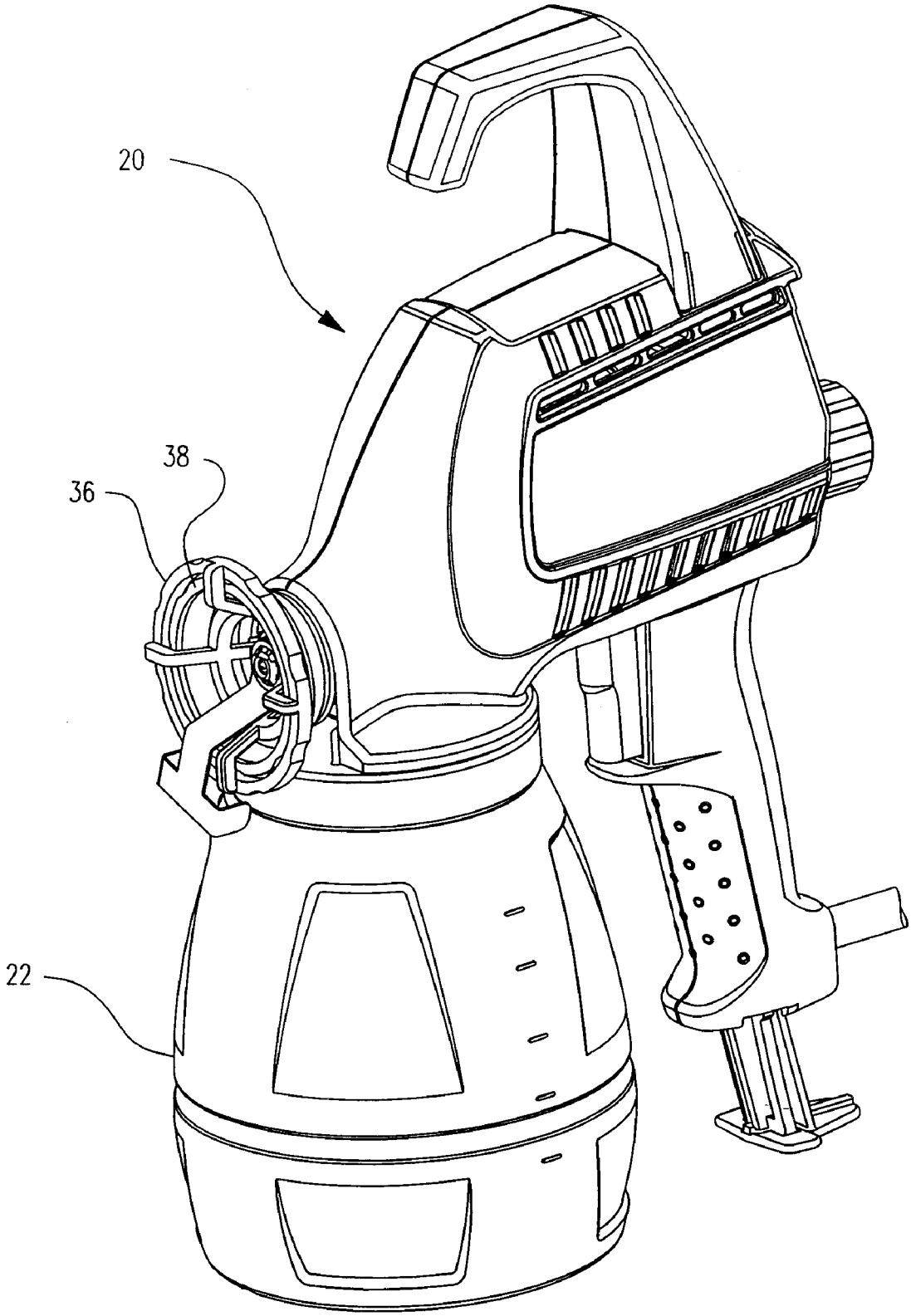
Fig. 1 PRIOR ART
FIG. 1 is a perspective view of a hand held paint sprayer useful in the practice of the present invention.
Figure 2:
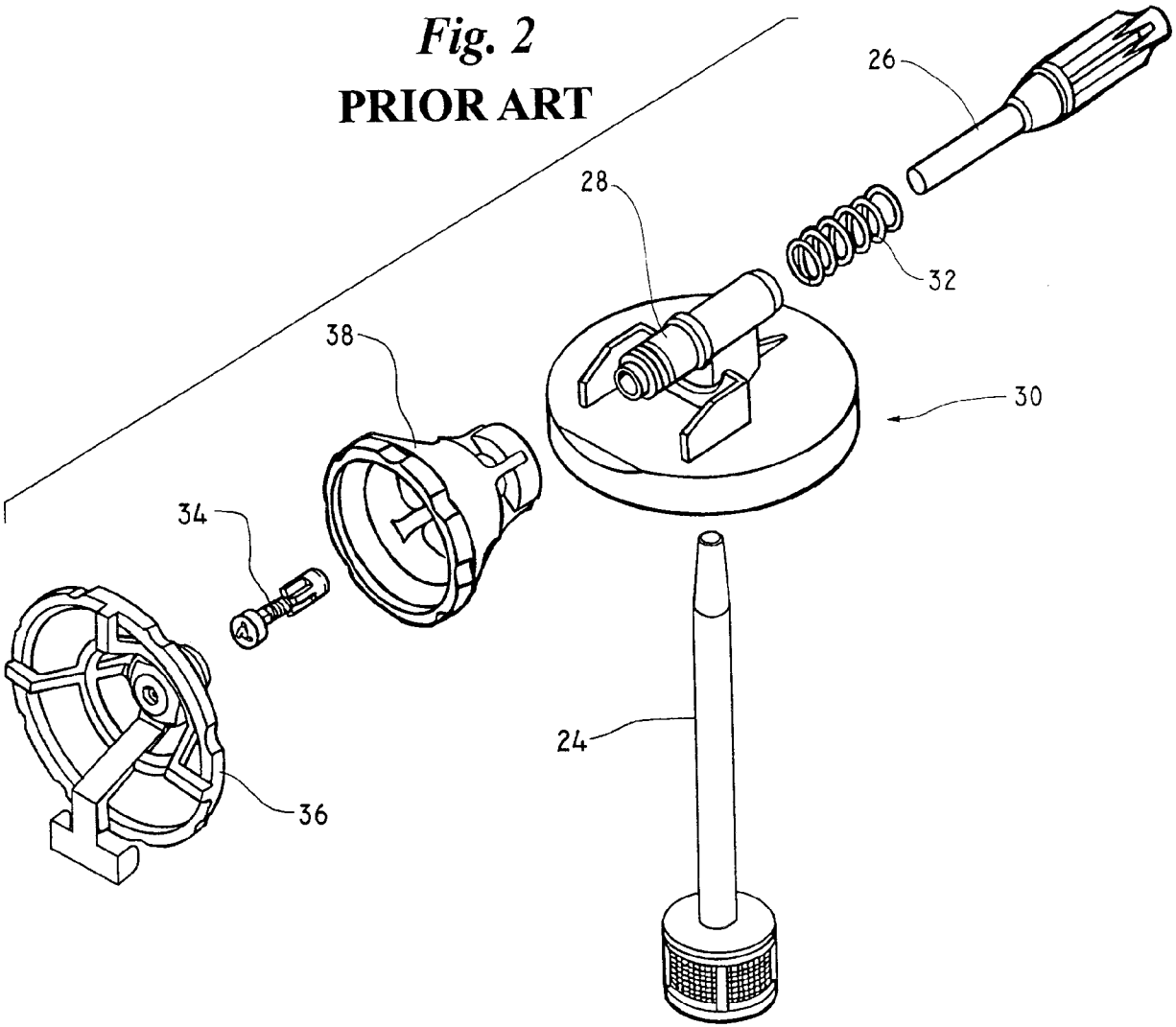
Fig. 2 PRIOR ART
FIG. 2 is an exploded view of wetted parts (except for the cup) from the paint sprayer of FIG. 1 that need to be cleaned after use.
Figure 3:
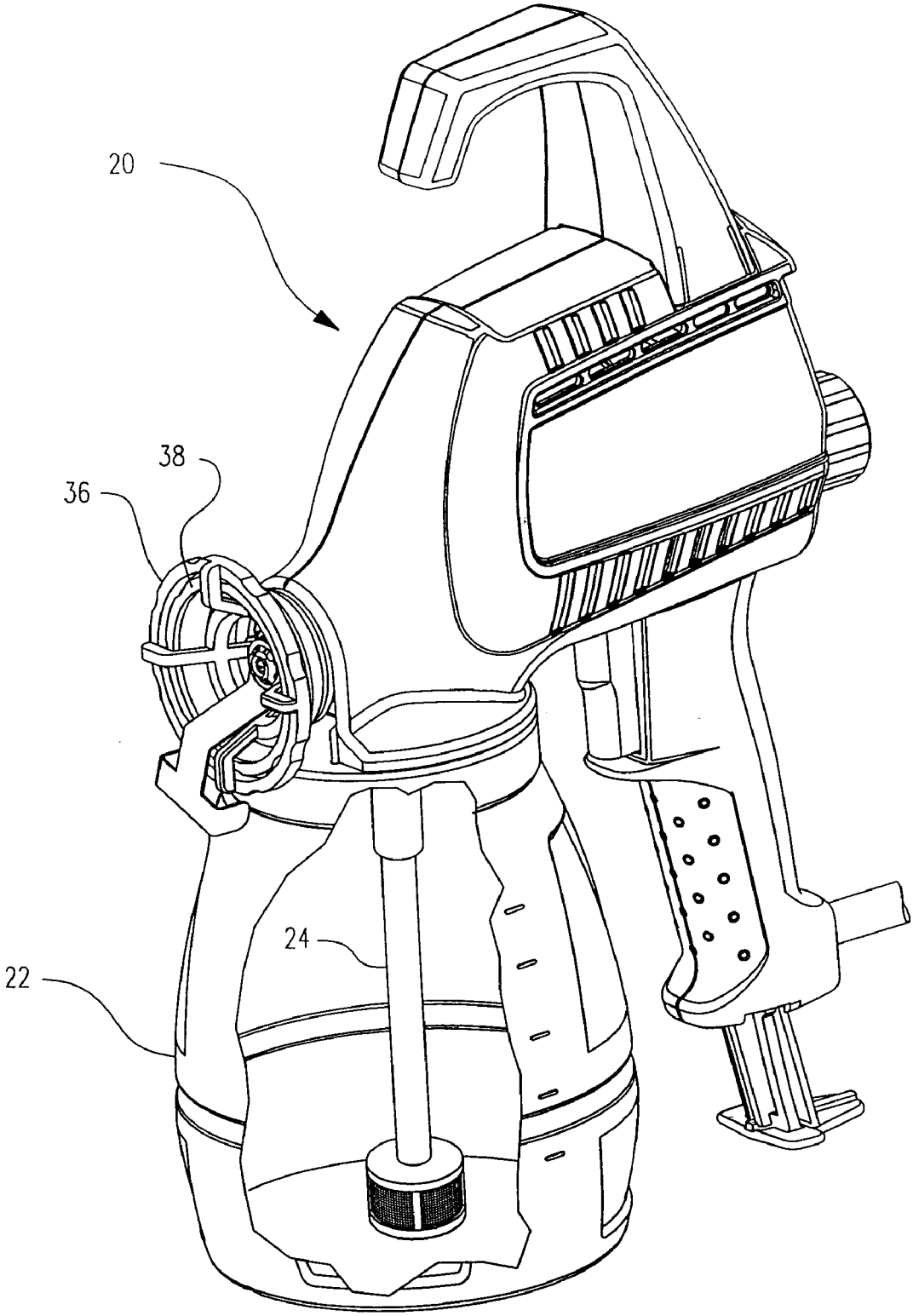
Fig. 3 PRIOR ART
FIG. 3 is a view similar to that of FIG. 1, except partially cut away to show a paint suction set including a syphon tube and strainer.

Referring to the figures, and most particularly, to FIG. 1, a hand held paint spray gun 20 may be seen. In this figure, spray gun 20 is attached to a paint cup 22. In operation, gun 20 draws paint from cup 22 via a syphon tube and strainer 24 (see FIG. 3) and delivers paint in a finely atomized spray via a piston 26 reciprocating in a cylinder 28 in a pump housing 30. An electromagnetic motor (not shown) drives piston against a spring 32 (see FIG. 2), causing paint to be delivered to a swirl valve 34 and then atomized by a paint spray nozzle or tip 36. The wetted parts are shown in FIG. 2 in an exploded view. A locking nut 38 retains the pump housing 30, spring 32 and piston 26 to gun 20 for spraying, while also allowing easy removal for cleaning.

Figure 4:
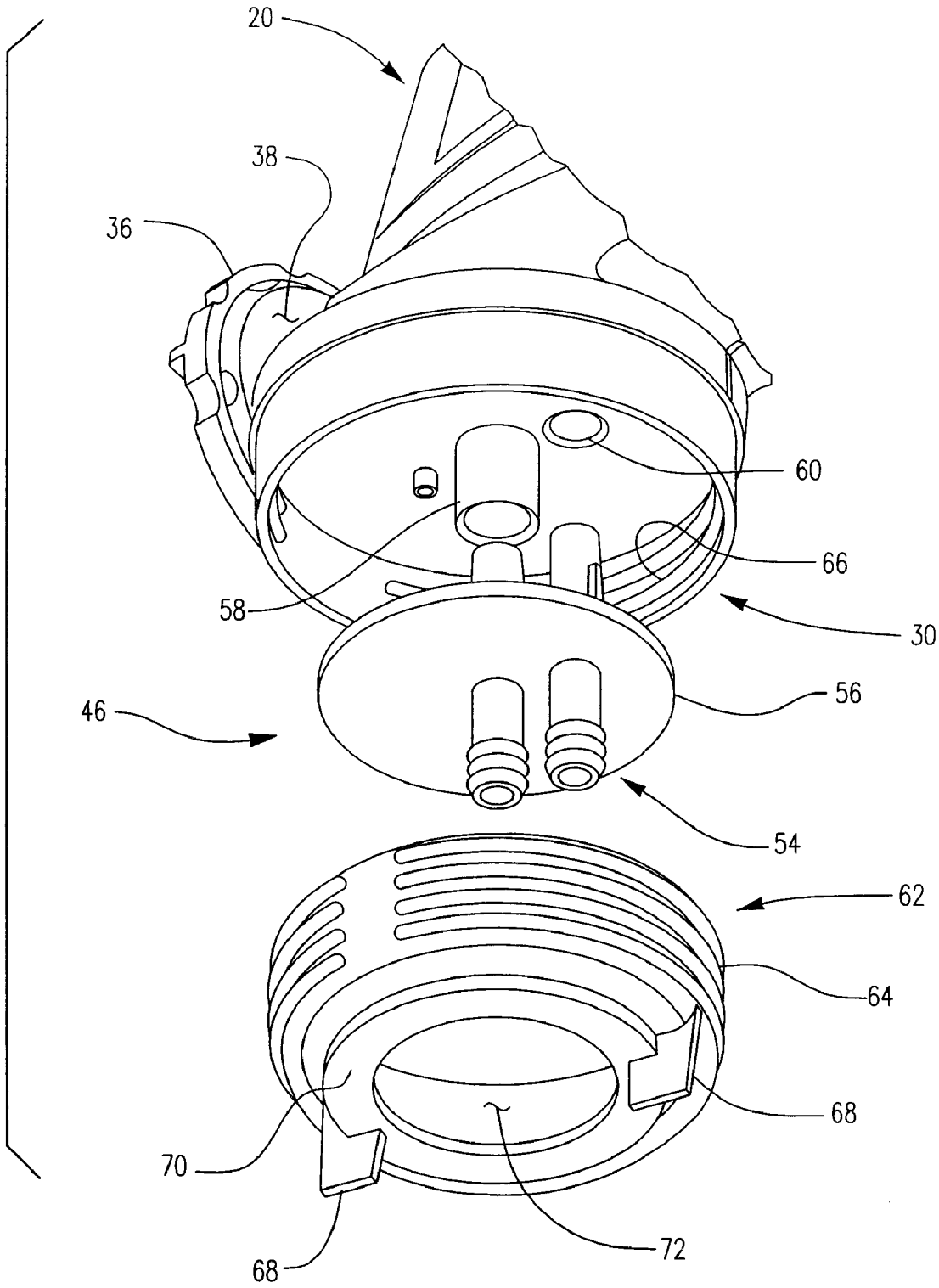
Fig. 4 PRIOR ART
FIG. 4 is a fragmentary exploded view of an alternative arrangement of parts for an extended suction set for the paint sprayer of FIG. 1.
Figure 5:
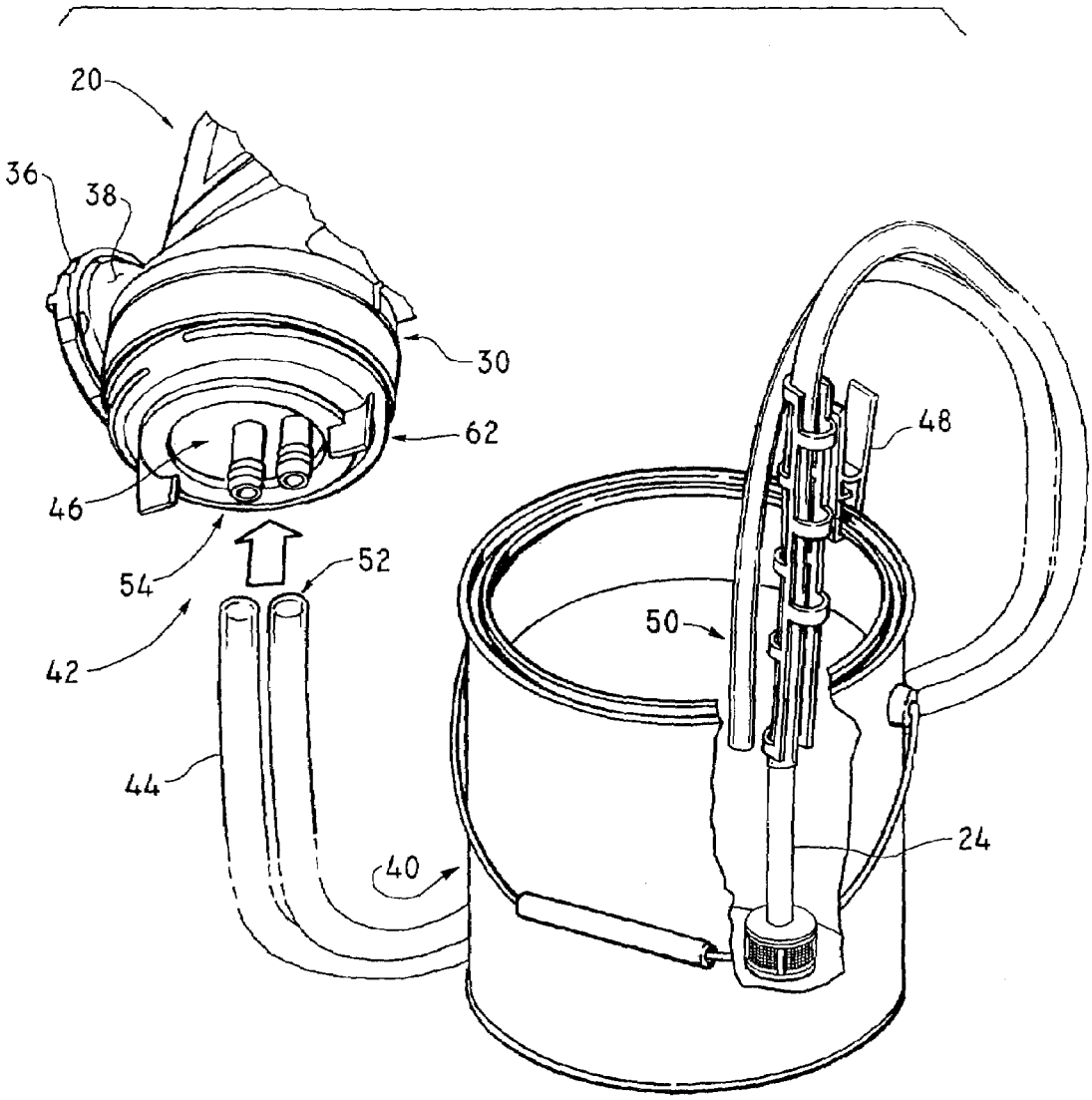
Fig. 5 PRIOR ART
FIG. 5 is a fragmentary assembled view of the parts shown in FIG. 4 illustrating a hose connection between the paint sprayer of FIG. 1 and a remote paint reservoir such as a conventional one gallon paint can, with the paint can cut away to show the syphon tube and strainer.

Referring now to FIGS. 4 and 5, an alternative arrangement is to replace the paint cup 22 with a remote paint reservoir, such as a conventional paint can 40, and deliver paint from can 40 to gun 20 via an extended suction set 42 which includes a double lumen hose 44 and dual hose fitting 46. A container clip 48 may be used to hold a distal end 50 of the hose 44 in container 40, with the syphon tube and strainer 24 preferably attached to the distal end 50 of the hose 44. A proximal end 52 of hose 44 is preferably received on a pair of barbed fittings 54 integrally formed in dual hose fitting 46 which also has a generally circular plate-like portion 56. It is to be understood that the lumen in fluid communication with the syphon tube and strainer 24 is connected through one of the barbed fittings 54 to an inlet port 58 in the pump housing 30. The other lumen is in fluid communication with a leak or bypass port 60, to return any paint leaking past piston 26 in cylinder 28 to the paint container 40.

A pump housing locking collar 62 secures the dual hose fitting 46 to the pump housing 30 during spraying operation. A set of external threads 64 on collar 62 are sized to interengage with internal threads 66 on pump housing 30. A pair of tabs 68 extend from a planar surface 70 having an aperture 72 therein. Aperture 72 is sized to permit the fittings 54 to extend through collar 62, while retaining the plate-like portion 56 with planar surface 70 when collar 62 is threaded into pump housing 30, with the tabs 68 available to provide a convenient way to apply the rotational force necessary to install and remove collar 62 from pump housing 30.

Figure 6:
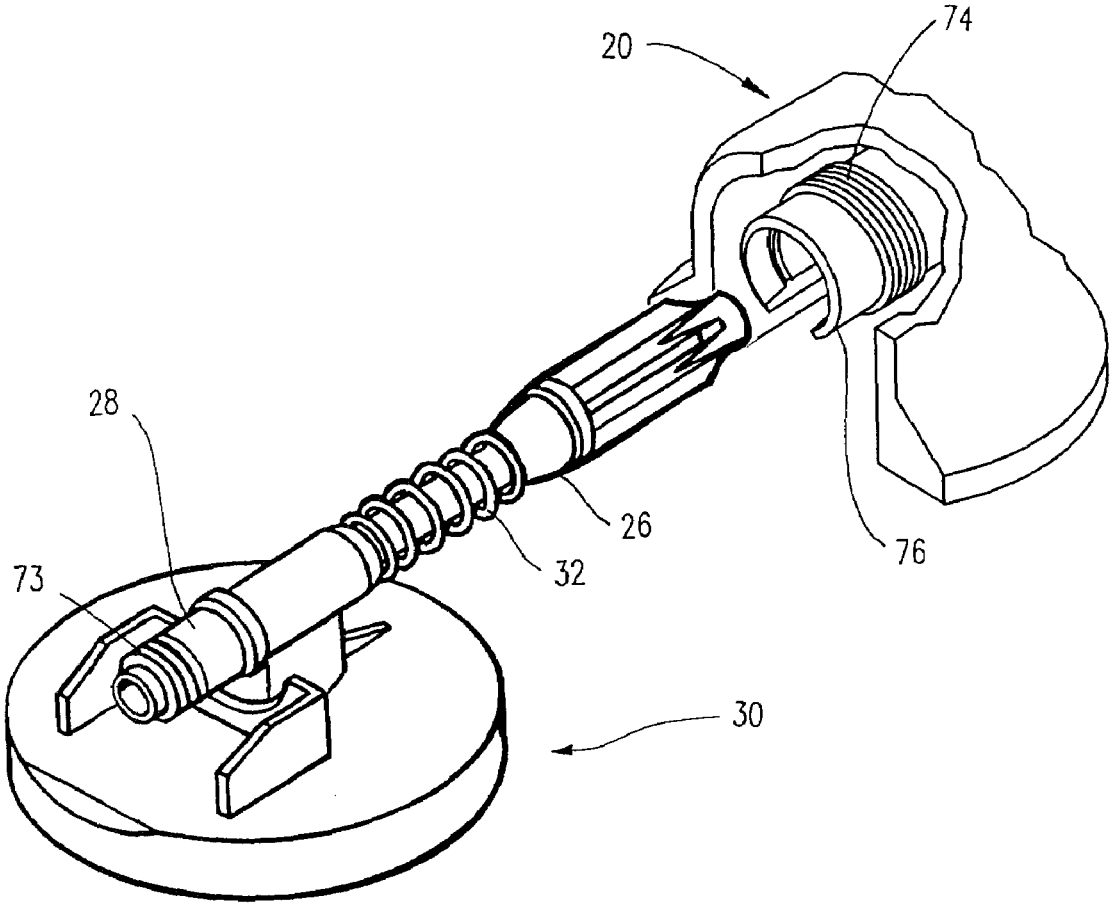
Fig. 6 PRIOR ART
FIG. 6 is a fragmentary, partially exploded view of parts from FIG. 2 as they are being disassembled for cleaning.

Referring now to FIG. 6, once spraying is complete, parts that are wetted from the material sprayed (the "wetted parts") can be disassembled from the paint spray gun 20 by unscrewing the tip 36 from threads 73 on cylinder 28, removing the swirl valve 34 from cylinder 28, and unscrewing the locking nut 38 from threads 74 on the motor housing 76. In the embodiment shown, the wetted parts include the nozzle or tip 36, the swirl valve 34, the locking nut 38, the cylinder 28 and pump housing 30, spring 32, piston 26, syphon tube and strainer 24, and paint cup 22. It is to be understood that in normal spraying the spring 32 may not be wetted, but in disassembling the piston 26 from cylinder 28, the spring will typically become contaminated with material that has been sprayed, and thus become one of the "wetted" parts. It is to be further understood that the list of wetted parts is to be considered illustrative and not limiting, in that in certain circumstances, more or fewer (or different) parts may become wetted during operation or disassembly and thus require cleaning. If such additional or different wetted parts will fit within the cup, they are to be considered within the scope of the present invention.

To clean the wetted parts just disassembled according to the present invention, the spray tip 36, swirl valve 34, locking nut 36, spring 32, syphon tube and strainer 24, and piston 26 may be placed in paint cup 22. Once the parts are placed in the paint cup 22, a cleaning cap 80 according to the present invention may be attached to the cup 22, preferably by threading the cap 80 and cup 22 together, after which a garden hose 82 is attached to the cap 80, and water is used to flush paint from the paint cup 22 and the wetted parts contained in the cup 22. Approximately 30 seconds flushing with water is recommended for cleaning, but more time may be used if necessary. The cleaning cap 80 may also be used to clean the extended suction set 42, if desired, as will be described below.

Figure 7:
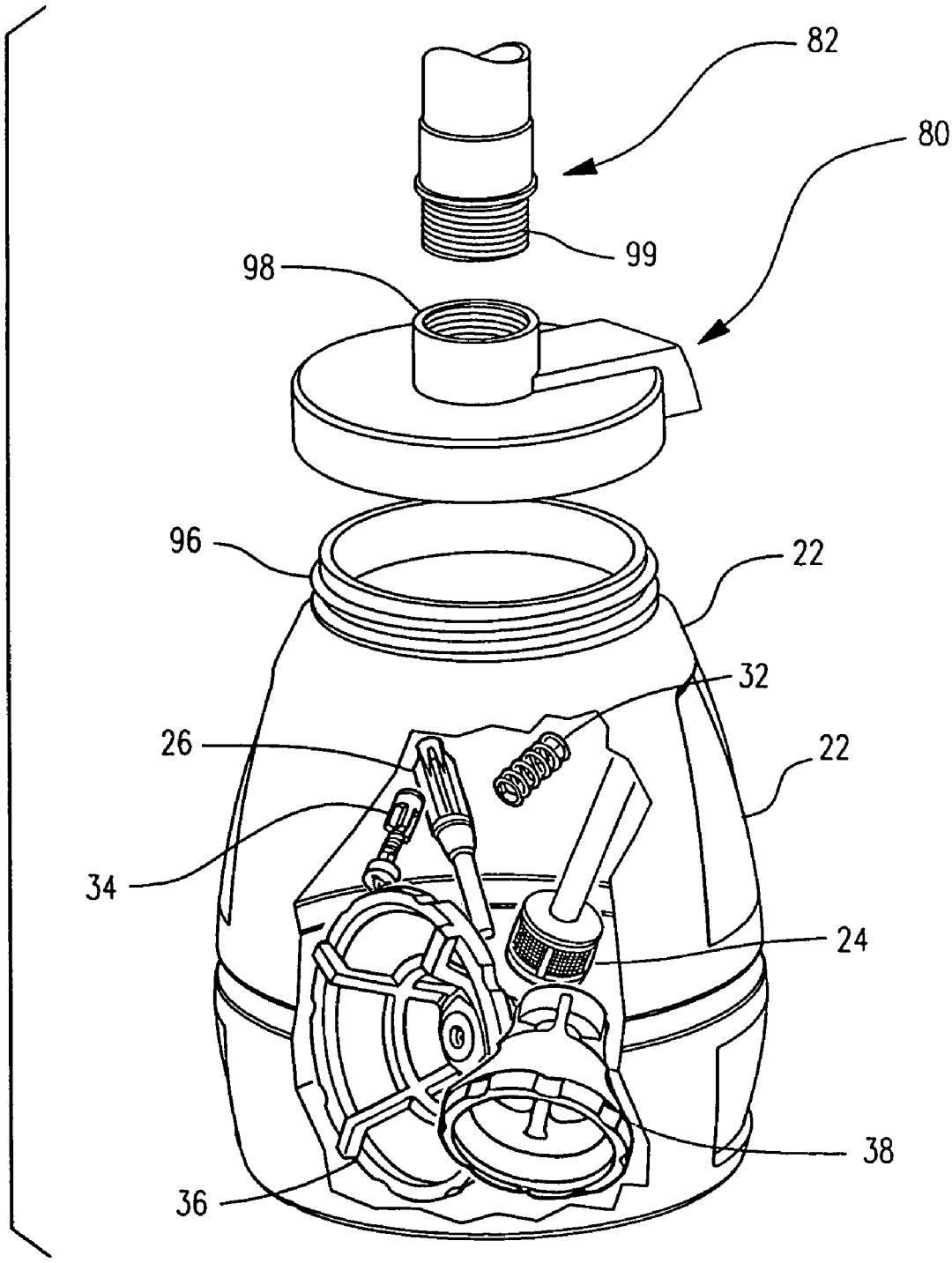
FIG. 7 is an exploded perspective view of a portion of a garden hose and cleaning cap being assembled to a paint cup with a section cutaway to show sprayer parts received in the paint cup for cleaning according to the present invention.
Figure 8:
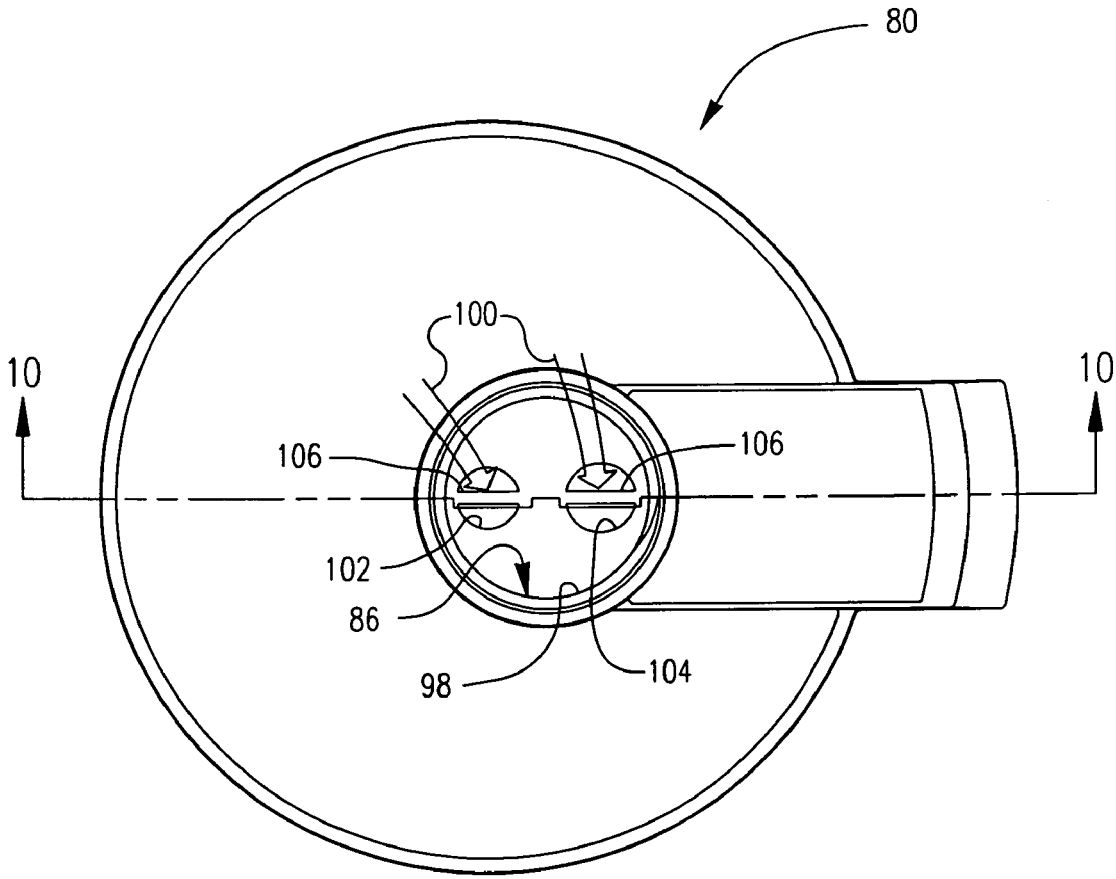
FIG. 8 is a top plan view of the cleaning cap from FIG. 7.
Figure 9:
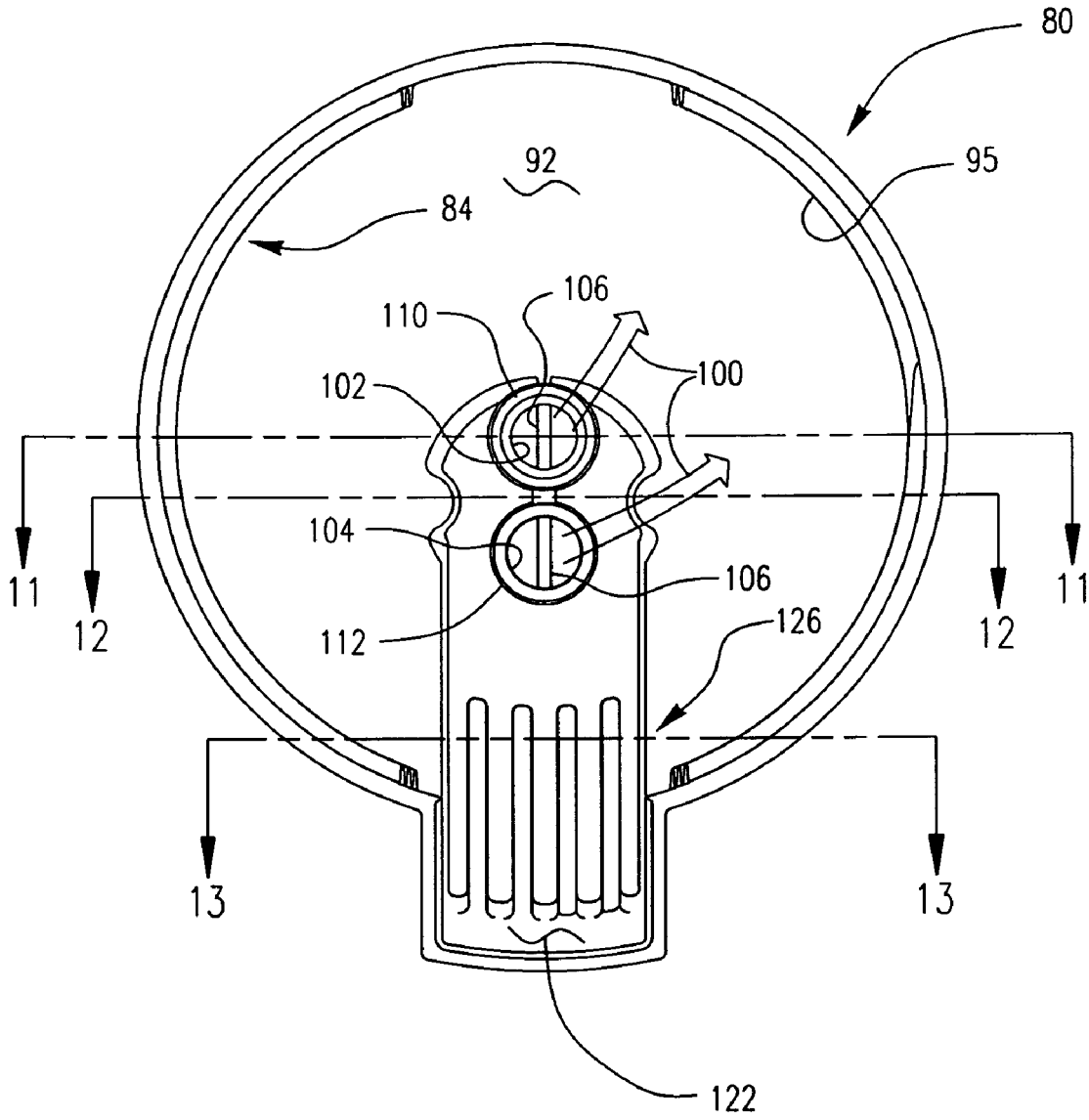
FIG. 9 is a bottom view of the cleaning cap of FIG. 8.
Figure 10:
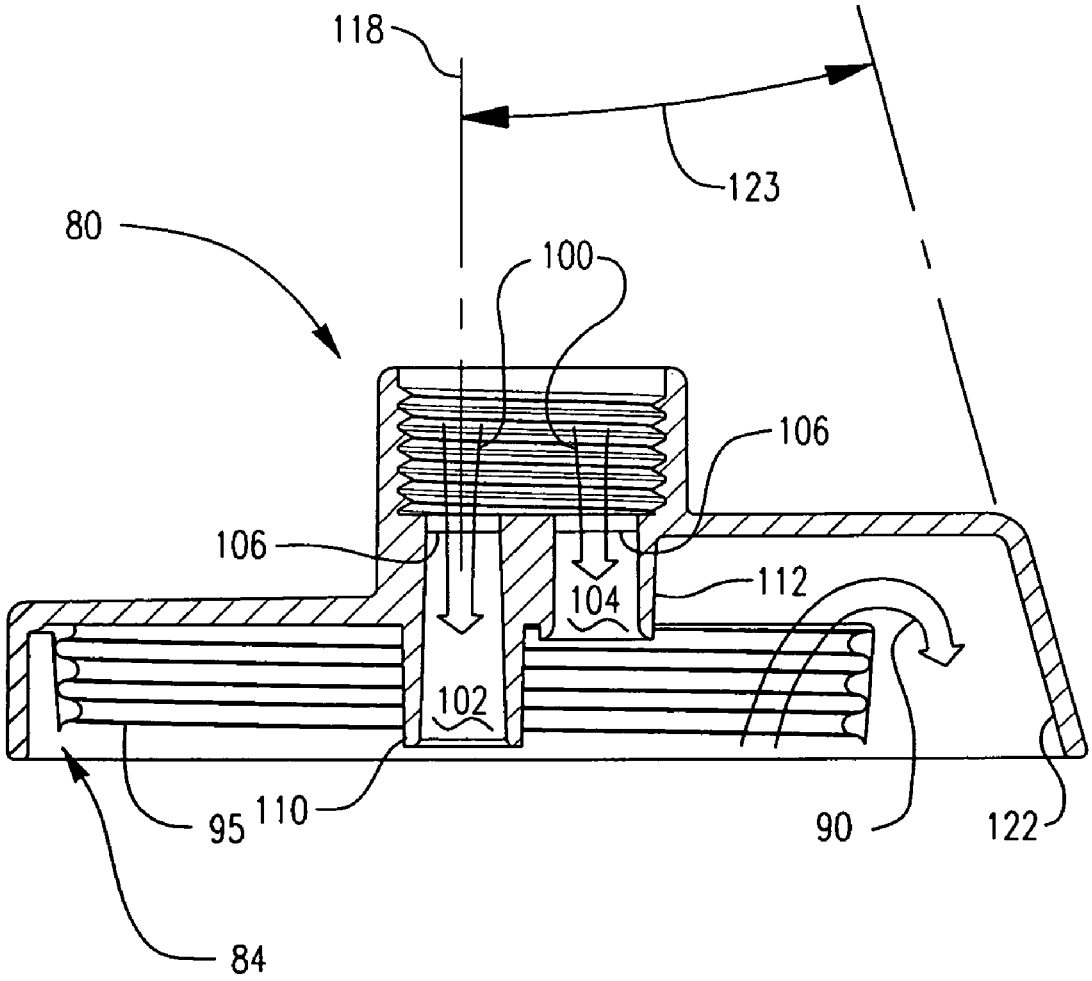
FIG. 10 is a side section view along line 10-10 of FIG. 8.
Figure 11:
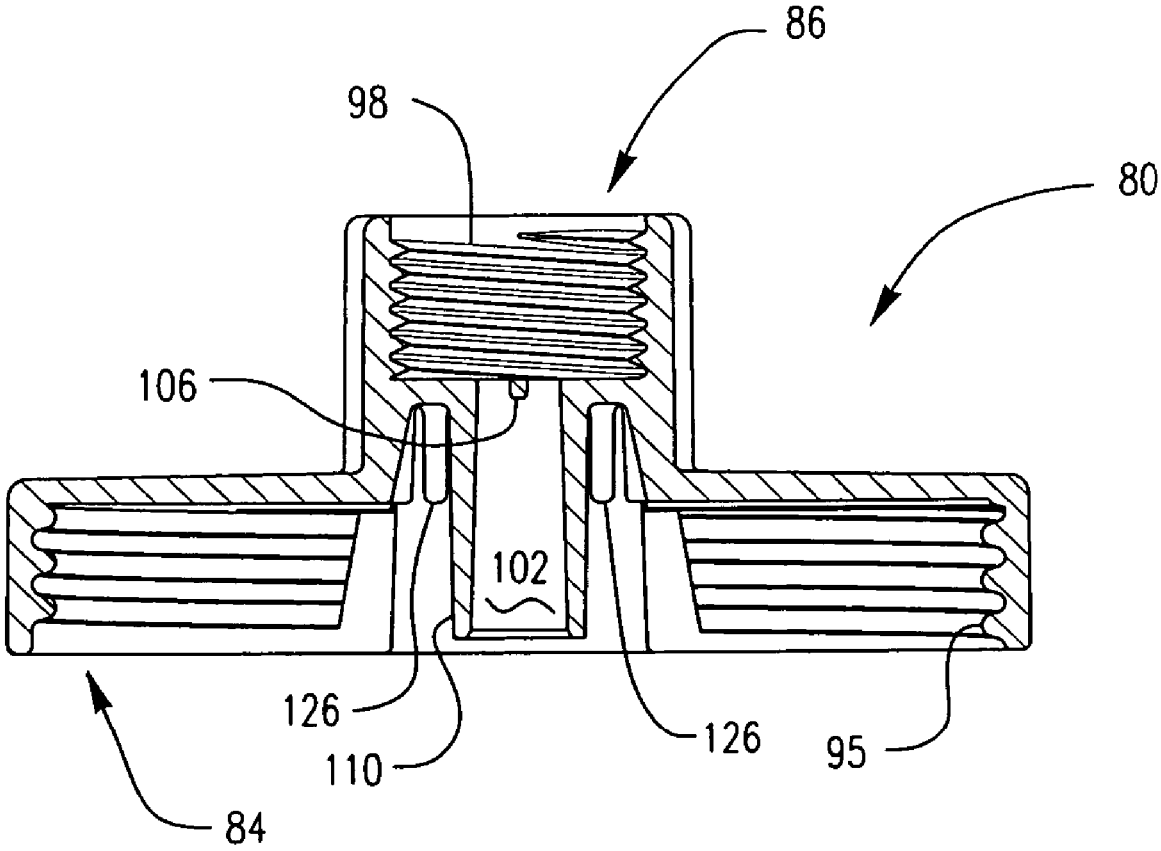
FIG. 11 is a first side section view along line 11-11 of FIG. 9.
Figure 12:
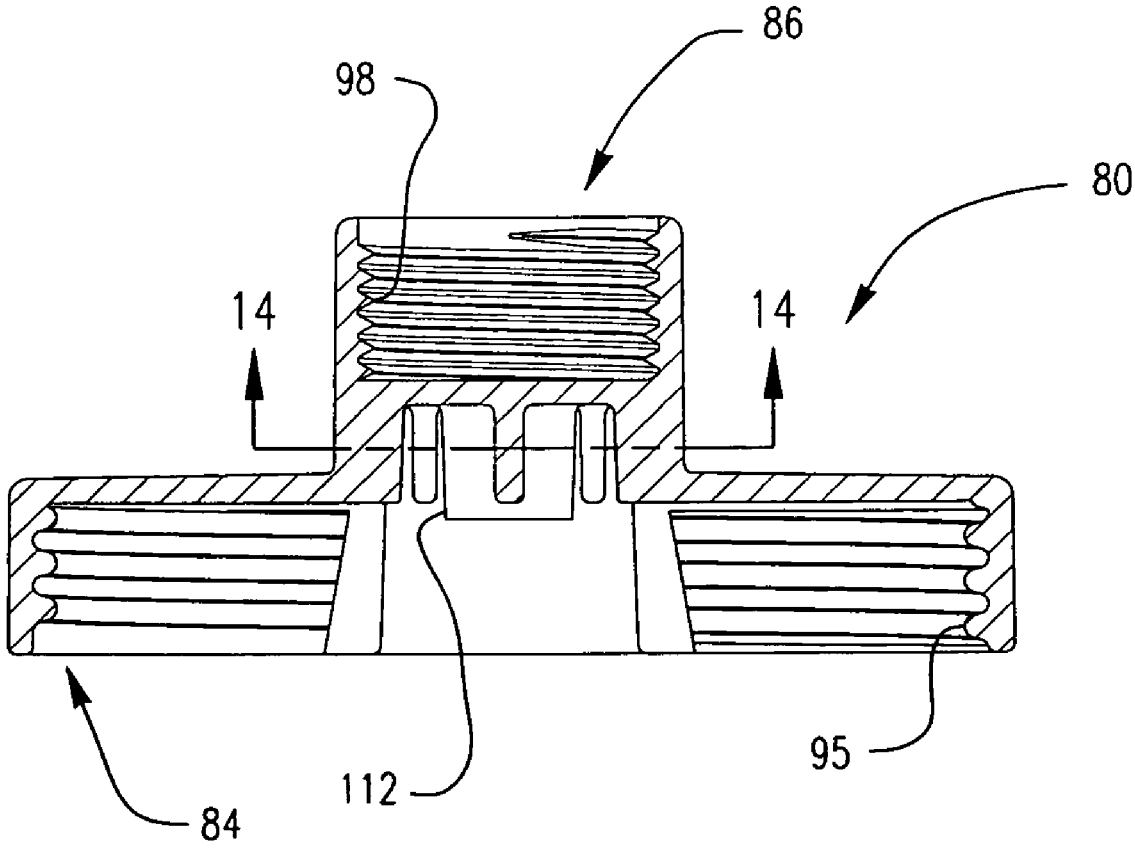
FIG. 12 is a second side section view along line 12-12 of FIG. 9.
Figure 13:
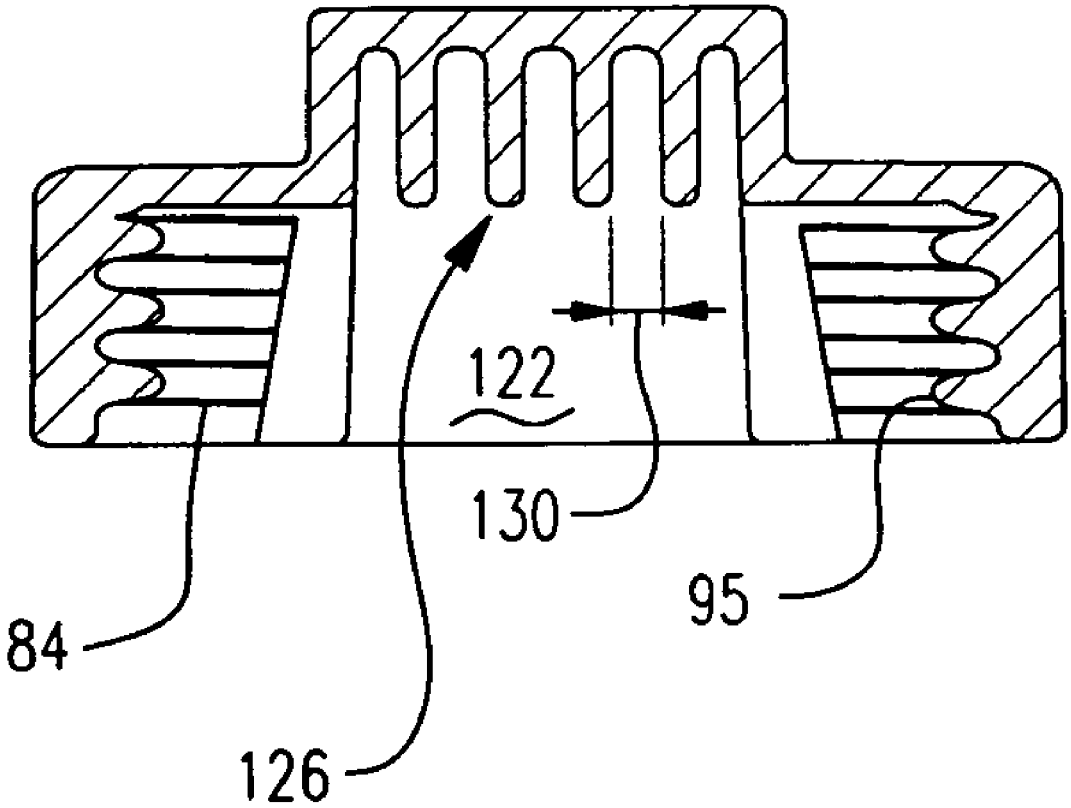
FIG. 13 is a third side section view along line 13-13 of FIG. 9.
Figure 14:
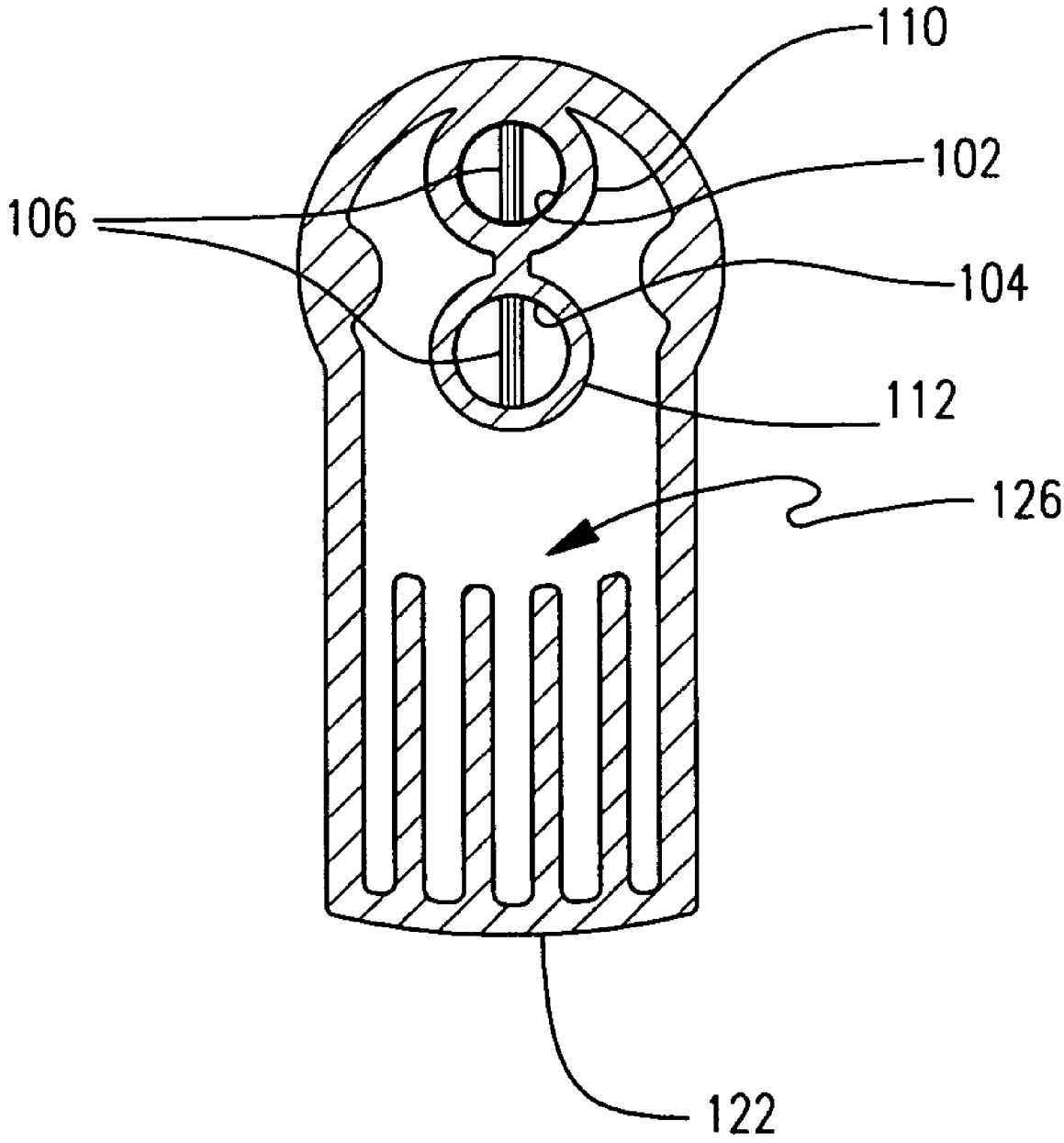
FIG. 14 is a side section view along line 14-14 of FIG. 12.
Figure 15:
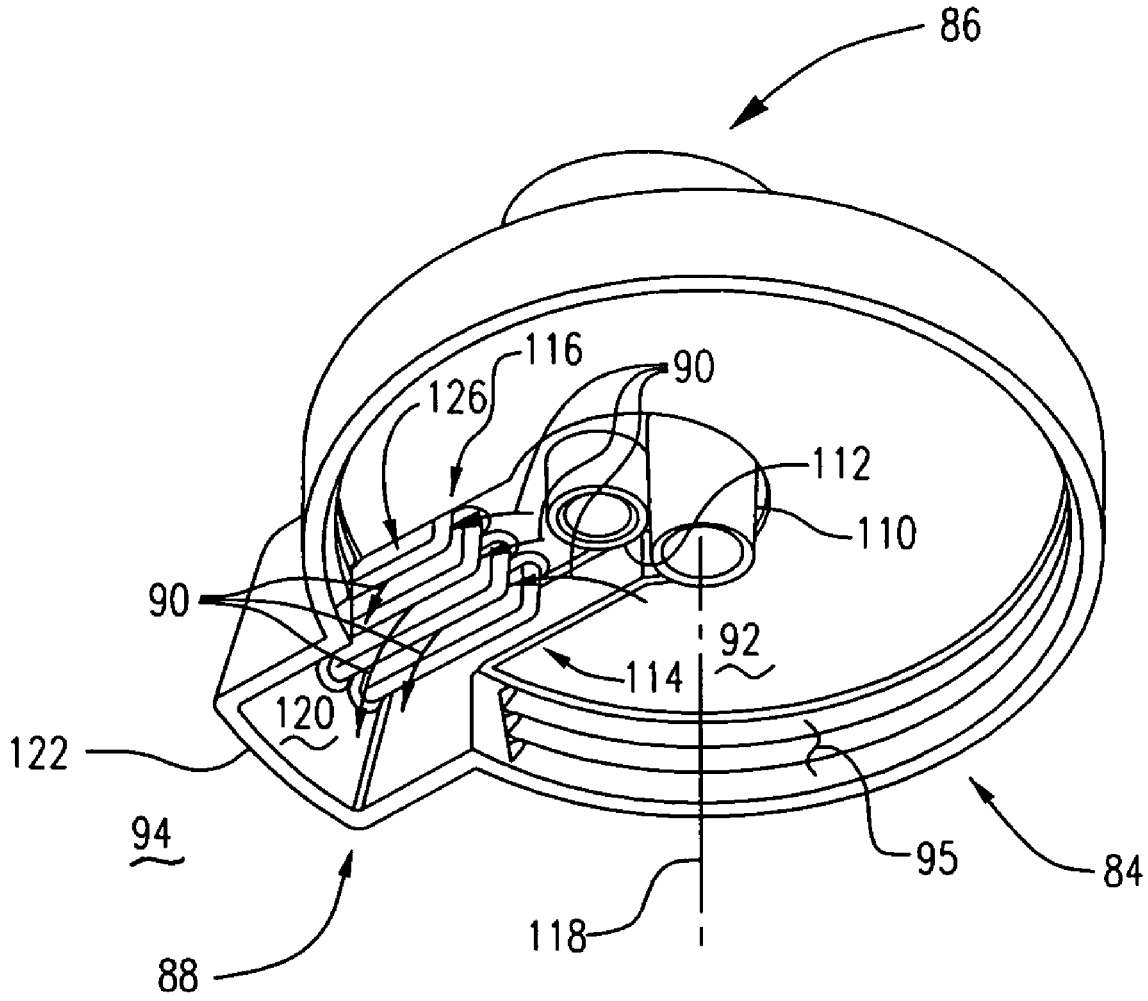
FIG. 15 is a perspective view of the cleaning cap of FIG. 8 from the interior side to show certain details of the interior of the cleaning cap.

Referring now to FIGS. 8 through 15, various views of the cleaning cap 80 of the present invention may be seen. It is to be understood that the cleaning cap 80 is an apparatus for cleaning parts which have been in contact with paint from a hand-held paint spray gun. The cleaning cap 80 has a first fitting 84 for receiving the paint cup 22 and a second fitting 86 for receiving the garden hose 82. In addition, cap 80 has an outlet passageway 88 providing an outlet fluid communication path indicated by arrows 90 from an interior 92 of the cap to the exterior environment 94 of the cap 80. The first fitting 84 of cap 80 has a first set of threads similar to threads 66 to mate with external threads 96 on cup 22 (see FIG. 7). The second fitting 86 has a second set of threads 98 which are female hose threads, more particularly, ¾-11.5 NH American Standard Hose Coupling threads suitable for mating with a conventional male garden hose coupling 99 (see FIG. 7). The cap 80 has an inlet fluid communication path indicated by arrows 100 from the second fitting 86 to the interior 92 of the cap. The inlet fluid communication path 100 includes a pair of apertures 102, 104 each of which have a partial obstruction in the form of a crossbar 106 extending diametrically thereacross. Each of the apertures 102 and 104 are in fluid communication with and surrounded by one of a pair of sleeves 110, 112 extending into the interior of cap 80. Crossbars 106 provide a barrier to small parts (such as the swirl valve 34 from passing through either aperture 102 or 104 and escaping from the interior of the cap 80 when assembled to the paint cup 22. The partial obstructions or crossbars 106 also provide a positive stop for the dual hose fitting 46, to prevent overtightening of the connection between the cap 80 and fitting 46, as the collar 62 is threaded into threads 95 of the cap 80. It is to be understood that other shapes may be used in place of crossbars 106 to accomplish one or both of these purposes.

Figure 16:
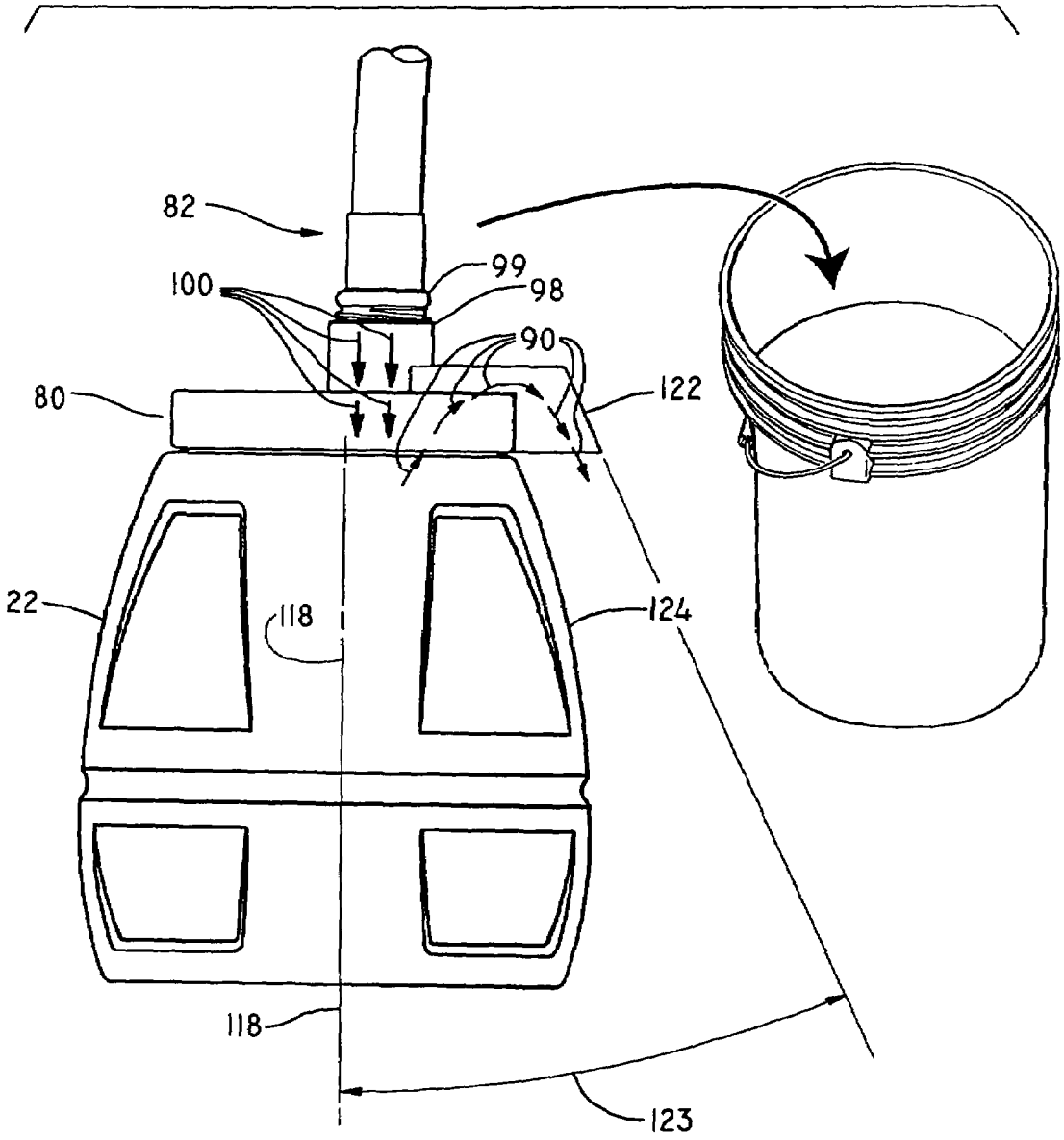
FIG. 16 is a view of the cleaning cap assembled to the paint cup containing parts to be cleaned and attached to a garden hose and about to be placed in an empty bucket.

The outlet fluid communication path 90 is in the form of a trough or channel 114 extending from the interior 92 of the cap 80 to the region exterior of the cap 80, and more particularly, provides a flow path for fluid to exit from within the assembled cap 80 and cup 22 to the region 94 exterior of the cap 80. Channel or trough 114 surrounds at least a portion of the sleeves 110, 112, and preferably extends completely around and is spaced apart from sleeves 110 and 112. A first portion 116 of trough 114 extends in a generally radial direction (as referenced to an axis 118 of threads 95) and a second portion 120 extends in a generally axial direction, although an end wall 122 is preferably located at an angle 123 of at about 15 degrees with respect to axis 118, allowing the water exiting the second portion of the channel 114 to flow generally parallel to an exterior wall 124 of cup 22 (see FIG. 16). It may thus be seen from FIG. 16 that the outlet fluid communication path 90 extends from the interior 92 of the cap 80 to the exterior 94 of both the cap 80 and cup 22 when the cap 80 is attached to the paint cup 22. It is to be understood that channel 114 forms an inverted trough when the cap 80 is located in an upright position, as shown in FIG. 16, and in that position, the second portion 120 is oriented downward to direct water exiting the cap in a downward direction.

Cleaning cap 80 also has a plurality of ribs or fins 126 in the channel 114 to prevent expelling the swirl valve 34 (which is small enough to pass through the channel 114) during cleaning. Each of the fins 126 is preferably aligned with the direction of flow, and together the fins provide an effective barrier to prevent expulsion of parts being cleaned, while at the same time the spaces between the fins are sized to avoid substantially restricting fluid flow, to allow agitation of the parts in the cup during cleaning. More specifically, a maximum distance or gap 130 between adjacent fins 126 (see FIG. 13) is sized to be smaller than the smallest outside dimension of the smallest part to be cleaned. By "smallest outside dimension" is meant the dimension on the part that will prevent the part from passing through the gap 130, assuming the part is free to be oriented to any position relative to the gap 130. With the wetted parts of the embodiment shown herein, the gap 130 is sized to be smaller than the largest diameter of the swirl valve 34. Ordinarily the swirl valve has a smallest outside dimension of 0.328 or 21/64 inches. However, the swirl valve has two polymer parts attached by a cylindrical compression spring. In the event the spring is separated from the polymer parts, the diameter of the spring is the limiting dimension. The smallest outside dimension of the spring is the outside diameter of the swirl valve spring in this embodiment, which is about 0.157 or 5/32 inches. To prevent the passage of the swirl valve spring, should it become separated, the gap 130 is set to 0.12 inches. Preferably, distance or gap 130 is the same between all fins and between the fins and the sides of trough 114. Furthermore, the fins 126 preferably extend upstream and downstream from the junction of the first (radial) portion and the second (axial) portion of the outlet fluid communication path. The upstream extension of fins 126 prevents any one of the parts being cleaned from being driven up against and (at least partially) blocking a generally planar opening in the outlet flow path 90. The downstream extension adds strength to the ribs 126 by allowing the ribs 126 to be attached to and formed integrally with end wall 122. Additionally, the downstream extension of fins 126 prevents large foreign objects from entering the paint cup through channel 114.

It is to be understood that the effluent from cleaning may be trapped and properly disposed of by placing the assembly of the hose 82, cleaning cap 80 and paint cup 22 (containing parts to be cleaned) in a conventional 5 gallon bucket, before water is caused to flow in the hose. During extended cleaning, the flow may be periodically interrupted to allow emptying of the effluent from the 5 gallon bucket.

Figure 17:
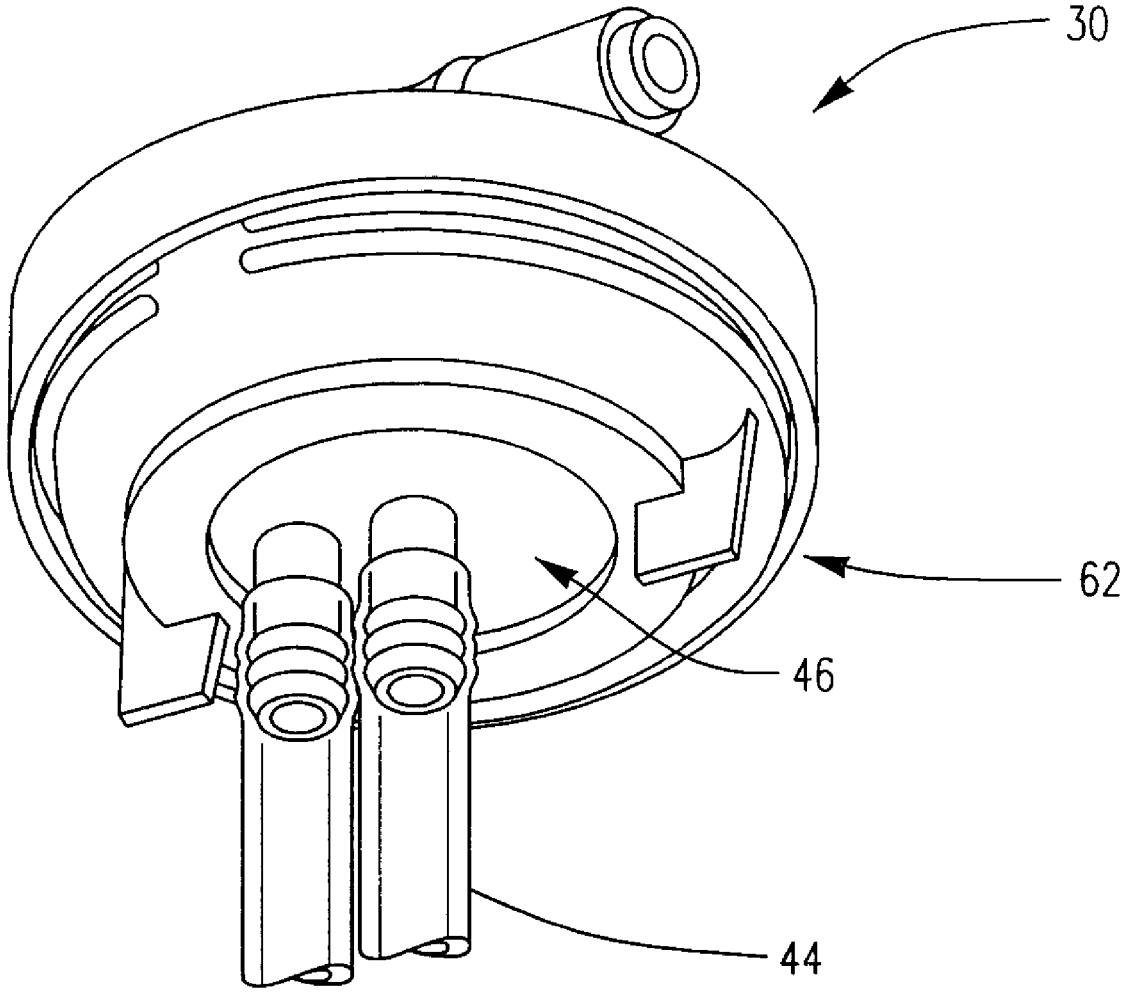
Fig. 17 PRIOR ART
FIG. 17 is a view of the extended suction set attached to a pump housing of the paint sprayer showing a first step in the disassembly thereof in preparation for cleaning.
Figure 18:
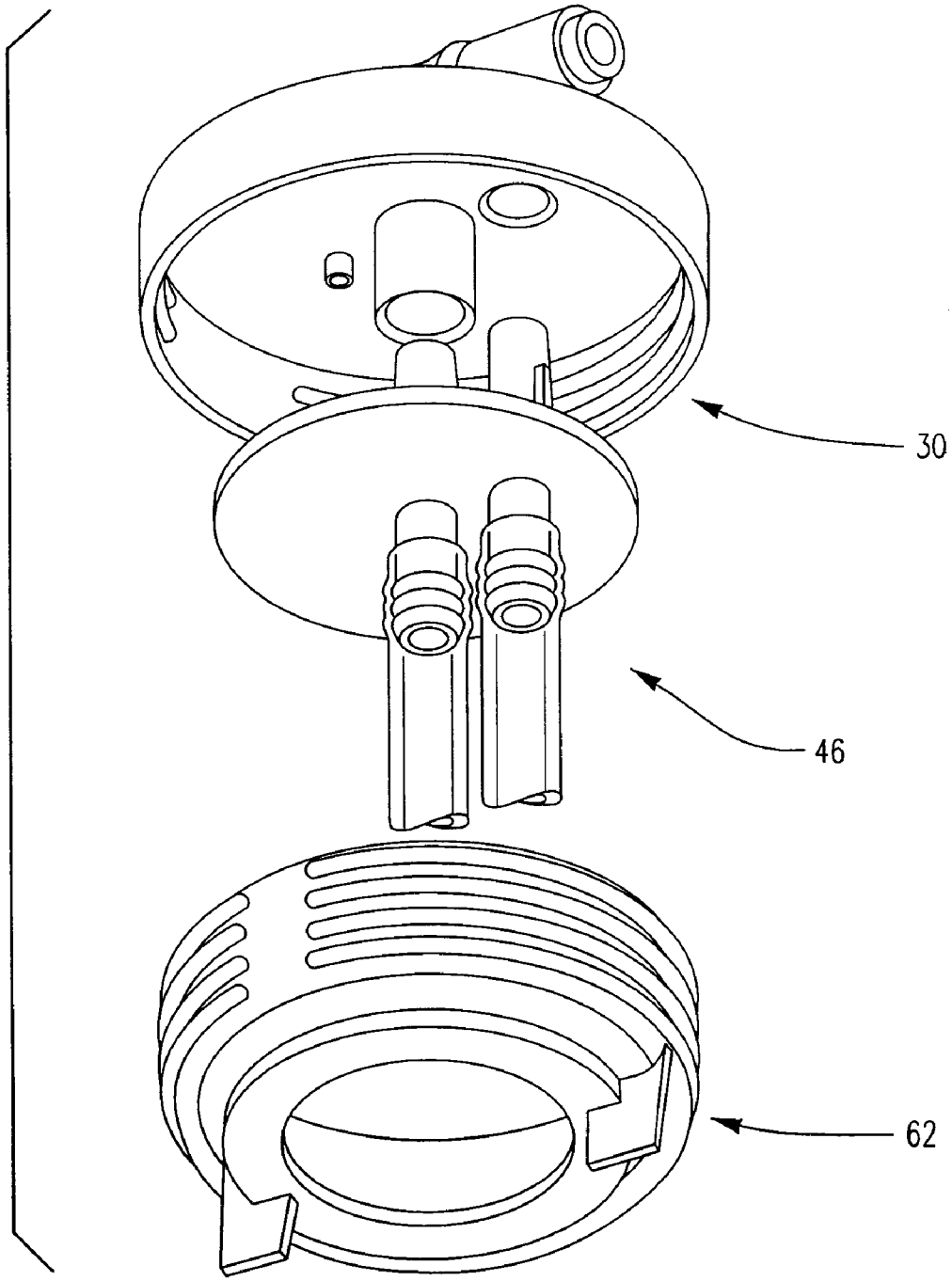
Fig. 18 PRIOR ART
FIG. 18 is a view similar to that of FIG. 17, except with parts disassembled.
Figure 19:
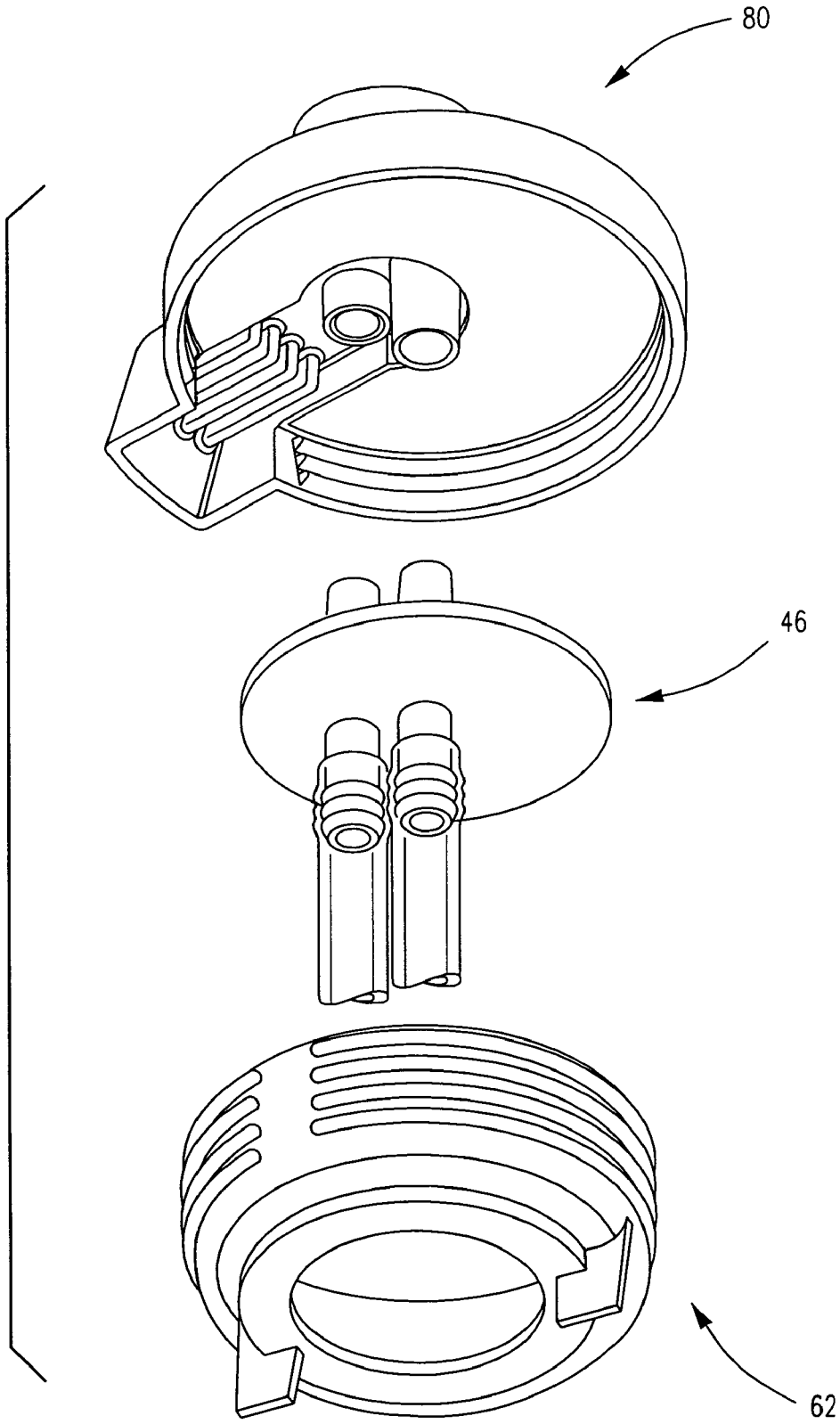
FIG. 19 is a view of an end of the extended suction set aligned for assembly to the cleaning cap in preparation for cleaning according to the present invention.
Figure 20:
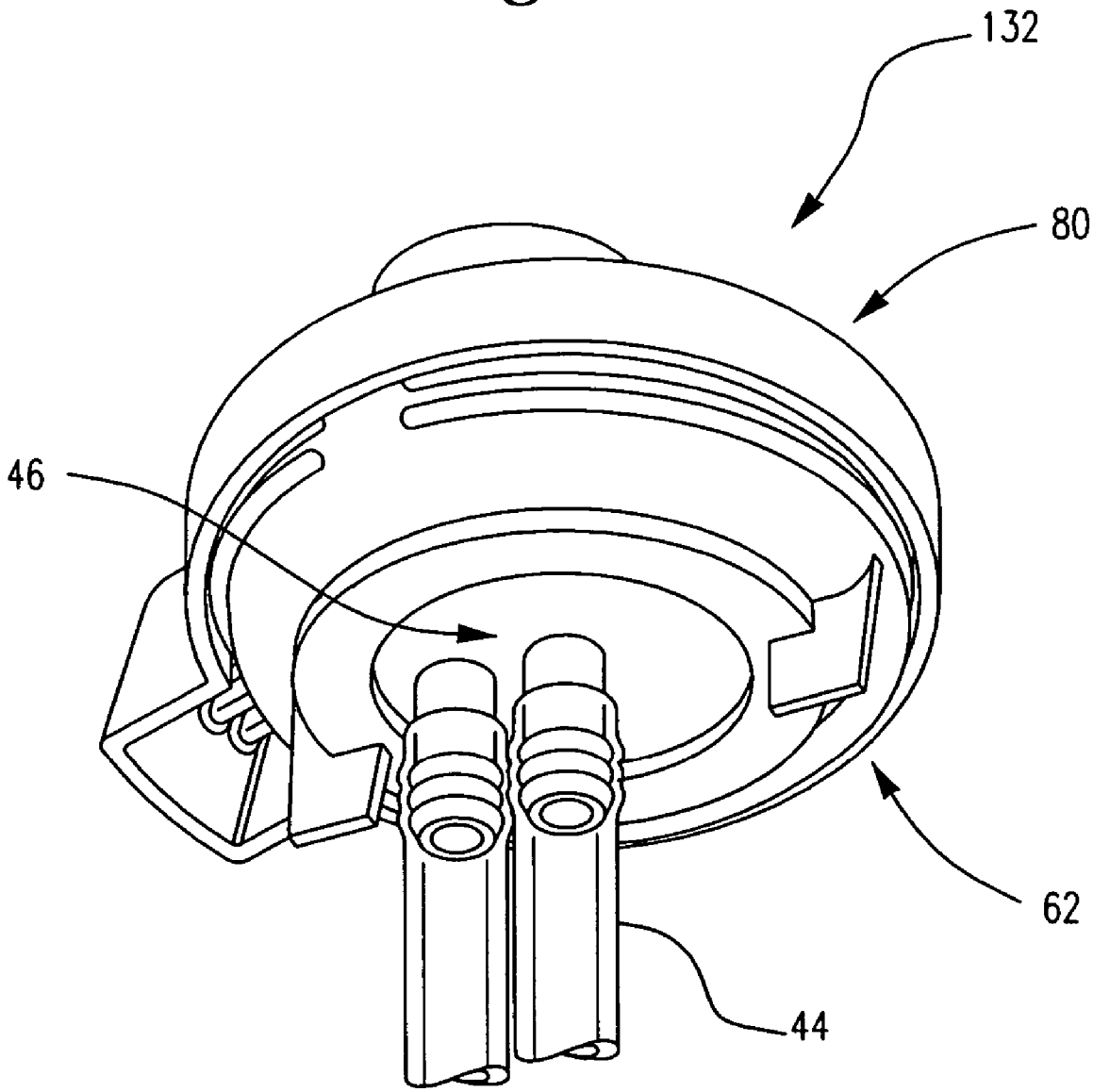
FIG. 20 is a view of the parts of FIG. 19 assembled together with a pump housing locking collar retaining the extended suction set to the cleaning cap.
Figure 21:
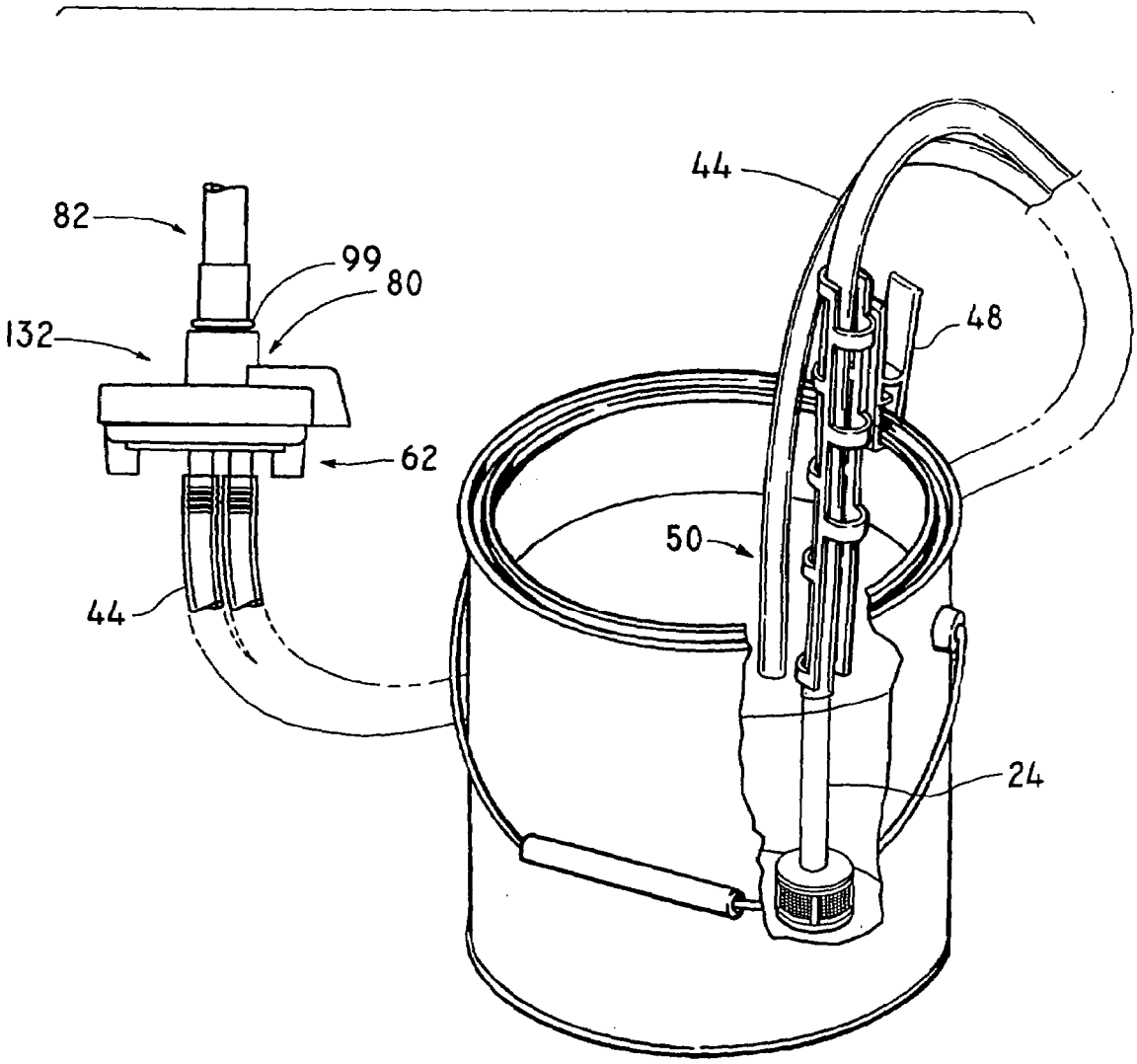
FIG. 21 shows the assembly of parts from FIG. 20 with a garden hose attached and with the distal end of the assembly of the extended suction set and cleaning cap placed into an empty bucket.

Referring now to FIGS. 17 through 21, if the extended suction set has been used, disassembling the pump housing 30 from the gun 20 will result in the subassembly shown in FIG. 17, where the double lumen hose 44 is secured through the dual hose fitting 46 by the pump housing locking collar 62. In preparation for cleaning the extended suction set, the collar 62 is unthreaded from the pump housing 30, and the dual hose fitting 46 is separated from the pump housing, all as shown in FIG. 18. Next, the cleaning cap 80 replaces the pump housing 30, as shown in FIG. 19, and the fitting 46 is engaged with the cap 80, and retained thereto by threading collar 62 into threads 95 of cap 80, resulting in the cleaning subassembly 132 which is to be understood to include hose 44 and syphon tube and strainer 24 at the distal end 50 of the hose 44. The garden hose 82 is attached to the inlet fitting 84 of subassembly 132, and at least the distal end 50 of hose 44 of the extended suction set 42 may be placed in a 5 gallon bucket, to retain effluent flushed from the extended suction set 42, similar to the operation described with respect to FIG. 16. However, it is to be understood that in subassembly 132 water passes from the garden hose 82 into and through the double lumen hose 44 through the dual hose fitting 46, exiting the hose 44 at the distal end thereof. With this arrangement, water does not ordinarily flow through the outlet flow path 90 of cap 80, since all of the water from garden hose 82 is forced to transit each of the lumens of hose 44, exiting only at the distal end 50 thereof. Approximately 30 seconds flushing with water is recommended for cleaning, but more time may be used if necessary.

The method of cleaning the wetted parts from the sprayer using the present invention may be performed as follows. In one aspect, the method includes the steps of disassembling wetted parts (i.e., the spray tip 36, locking nut 38, swirl valve 34, spring 32, and piston 26) from the paint spray gun 20, placing the wetted parts (along with the syphon tube and strainer 24) in the paint cup 22 and attaching the cleaning cap 80 to the paint cup 22. In this aspect, the cleaning cap 22 includes the first fitting 84 for receiving the paint cup 22, the second fitting 86 for receiving the garden hose coupling 99, and an outlet passageway 88 providing an outlet fluid communication path 90 from an interior 92 of the cap 80 to an exterior 94 of the cap. The method further includes attaching a garden hose 82 to the second fitting 86, and causing water to flow through the garden hose, cleaning cap and paint cup.

In another aspect, the method is applicable to cleaning an extended suction set 42 of the type having the double lumen hose 44 and dual hose fitting 46 for attachment to the hand held paint spray gun 20 using the pump housing locking collar 62 to hold the dual hose fitting 46 to the pump housing 30 of the paint spray gun 20. This aspect of the method includes the steps of disassembling the extended suction set from the paint spray gun, attaching the extended suction set to the cleaning cap 80 which includes a double lumen fitting 102, 104 for receiving the dual hose fitting 46, the integral female hose coupling 98 for receiving the male garden hose coupling 99, and the fluid passageway 114 providing a fluid communication path 90 from the female hose coupling to the double lumen fitting. In a manner similar to the first aspect, the method also includes attaching a garden hose to the female hose coupling and causing water to flow through the garden hose, cleaning cap and extended suction set.

As may be seen, the same apparatus for cleaning wetted parts internal to the spray gun may also be used for cleaning the extended suction set which has a double lumen hose and dual hose fitting for attachment to the hand held paint spray gun using the pump housing locking collar to hold the dual hose fitting to the pump housing of the paint spray gun. In this aspect, the cleaning cap includes a double lumen fitting for receiving a dual hose fitting, an integral female hose coupling for receiving a male garden hose coupling, and a fluid passageway providing a fluid communication path from the female hose coupling to the double lumen fitting such that when a garden hose is attached to the female hose coupling and water flowing through the garden hose will be directed through the cleaning cap and extended suction set.

This invention is not to be taken as limited to all of the details thereof as modifications and variations thereof may be made without departing from the spirit or scope of the invention.

What is claimed is:

1. Apparatus for cleaning a set of parts which had been in contact with paint from a hand-held paint spray gun during previous operation of the paint spray gun, the apparatus comprising;

a. a paint cup containing the set of parts; and b. a cleaning cap having:

i. a first fitting for receiving the paint cup;

ii. a second fitting for receiving a garden hose and having at least one aperture in fluid communication therewith directing substantially all fluid from the garden hose into the paint cup; and iii. an outlet passageway providing an outlet fluid communication path from an interior of the cap to an exterior of the cap and at least one barrier in the outlet passageway blocking the expulsion of any one of the set of parts from within the paint cup wherein the at least one barrier is a plurality of fins aligned with a direction of fluid flow in the outlet fluid communication path, and iv. an inlet fluid communication path from the second fitting to an interior of the cap wherein the inlet fluid communication path includes a first aperture and a second aperture, and a pair of sleeves, with each one of the pair of sleeves extending from and in fluid communication with a respective one of the first aperture and the second aperture.

2. The apparatus of claim 1 wherein the first fitting of the cleaning cap has a first set of threads.

3. The apparatus of claim 2 wherein the second fitting of the cleaning cap has a second set of threads.

4. The apparatus of claim 3 wherein the second set of threads are female hose fitting threads.

5. The apparatus of claim 3 wherein the second set of threads are female three quarter by eleven and a half standard hose coupling threads.

6. The apparatus of claim 1 further comprising a crossbar extending across at least one of the first aperture and the second aperture.

7. The apparatus of claim 1 wherein each of the first aperture and the second aperture has a partial obstruction of sufficient size to prevent the set of parts which are contained within the paint cup from passing through either the first or the second aperture.

8. The apparatus of claim 1 wherein at least one of the pair of sleeves has a crossbar extending thereacross.

9. The apparatus of claim 8 wherein the crossbar is positioned in the sleeve to provide a positive stop for a dual hose fitting received in the sleeve.

10. The apparatus of claim 1 wherein the outlet fluid communication path includes a trough extending from the interior to the exterior of the cap.

11. The apparatus of claim 10 wherein the trough surrounds at least a portion of the sleeves.

12. The apparatus of claim 11 wherein the trough extends completely around and is spaced apart from the sleeves.

13. The apparatus of claim 10 wherein the trough has a first portion oriented in a generally radial direction.

14. The apparatus of claim 13 wherein the trough has a second portion oriented in a generally axial direction.

15. The apparatus of claim 13 wherein the trough has a second portion oriented downward when the cap is located in an upright position.

16. The apparatus of claim 1 wherein the outlet fluid communication path extends from an interior of the cap to an exterior of the cup when the cap is attached to a paint cup.

17. The apparatus of claim 1 wherein the at least one barrier in the outlet passageway includes a fluid permeable barrier having a plurality of openings sufficiently large to permit the flow of water from the interior of the cap to the exterior of the cap and wherein the openings are sufficiently small to block the expulsion of any one of the set of parts being cleaned which had been in contact with paint from the paint spray gun wherein the fluid permeable barrier is a plurality of fins aligned with a direction of fluid flow in the outlet fluid communication path.

18. The apparatus of claim 17 wherein the fins are spaced apart a distance sufficiently small to prevent the passage of any one of the set of parts being cleaned.

19. The apparatus of claim 17 wherein the fins are spaced apart a distance less than the smallest outside dimension of the smallest part of the set of parts being cleaned.

* * * * *